United States Patent [19]

Lippincott, Sr.

[11] 4,319,369

[45] Mar. 16, 1982

[54] TOILET ADDITIVE DISPENSER

[76] Inventor: Richard L. Lippincott, Sr., 22122 Wood Island La., Huntington Beach, Calif. 92646

[21] Appl. No.: 187,799

[22] Filed: Sep. 16, 1980

[51] Int. Cl.[3] ..... E03D 9/03; E03D 9/02

[52] U.S. Cl. ..... 4/228; 4/223; 4/225

[58] Field of Search ..... 4/228, 227, 222, 225, 4/224, 223

[56] References Cited

U.S. PATENT DOCUMENTS

| | | | |
|---|---|---|---|
| 1,354,244 | 9/1920 | Clifford | 4/225 |
| 1,643,286 | 9/1927 | Burcham | 4/225 X |
| 2,479,842 | 8/1949 | Kirwan | 4/224 |
| 3,001,210 | 9/1961 | Diehl | 4/225 |
| 3,482,269 | 12/1969 | Tietema et al. | 4/225 |
| 3,623,167 | 11/1971 | Syrenne et al. | 4/225 |
| 3,890,657 | 6/1975 | Gray | 4/228 |
| 3,913,151 | 10/1975 | Keimig | 4/227 |
| 3,945,062 | 3/1976 | Corsette | 4/227 |
| 3,999,226 | 12/1976 | Wolf | 4/227 |

*Primary Examiner*—Henry K. Artis
*Attorney, Agent, or Firm*—William W. Haefliger

[57] ABSTRACT

The invention concerns disinfecting toilet bowls during reduced usages of flush water.

9 Claims, 4 Drawing Figures

TOILET ADDITIVE DISPENSER

BACKGROUND OF THE INVENTION

This invention relates generally to the treatment of toilet flush water, and more particularly concerns aeration of and disinfectant addition to such water.

The need to eliminate or reduce the wastage of water, especially in domestic use, has become important in recent times. In particular, large savings of water could be achieved were toilet flush water usage reduced.

Efforts to achieve such savings have included placement of objects such as blocks, bricks or liquid filled bags in toilet water holding tanks; however, these can damage the operation of flushing mechanism, and the consequent reduction in fluid flow to the toilet bowl can result in incomplete flushing. Also, reduced usage of flush water increases the problems of disinfecting the toilet bowl.

SUMMARY OF THE INVENTION

It is a major object of the present invention to provide apparatus which overcomes the above problems and difficulties, and at the same time achieves disinfecting of toilet flush water and substantial water economies. Basically, the device cooperates with the bottom wall drain opening of the flush water holding tank, and comprises:

(a) a tubular body located in drain communication with said opening and having an inlet spaced above the level of the opening so that only tank water above the level of the inlet will flow downward through the body during the toilet flush cycle, (b) the body containing a venturi to accelerate said flow, and (c) means connected with said body to conduct chemical fluid to said venturi, said means including a container supported by the tank.

As will appear, a lower portion of the body is typically received in the bottom wall drain opening; attachment means removably attaches the container to the wall of the flush tank, as for example within the tank; the chemical fluid consists of aqueous disinfectant removable from the container via a flexible tube having one end connected with the ducting and its opposite end inserted into the container to draw liquid from the container in response to flush water flow downwardly through the venturi; an anti-siphon device may be associated with that tube, whereby chemical liquid is only drawn to the venturi during the flush cycle; and air may be drawn to the same venturi via another duct in the body and via an air pipe in the toilet tank, to aerate the flush water flow and thoroughly mix the disinfectant liquid therewith.

This invention improves on the subject matter of U.S. Pat. No. 4,106,136 to Lippincott.

These and other objects and advantages of the invention, as well as the details of an illustrative embodiment, will be more fully understood from the following specification and drawings, in which:

DRAWING DESCRIPTION

DETAILED DESCRIPTION

Figure 1:
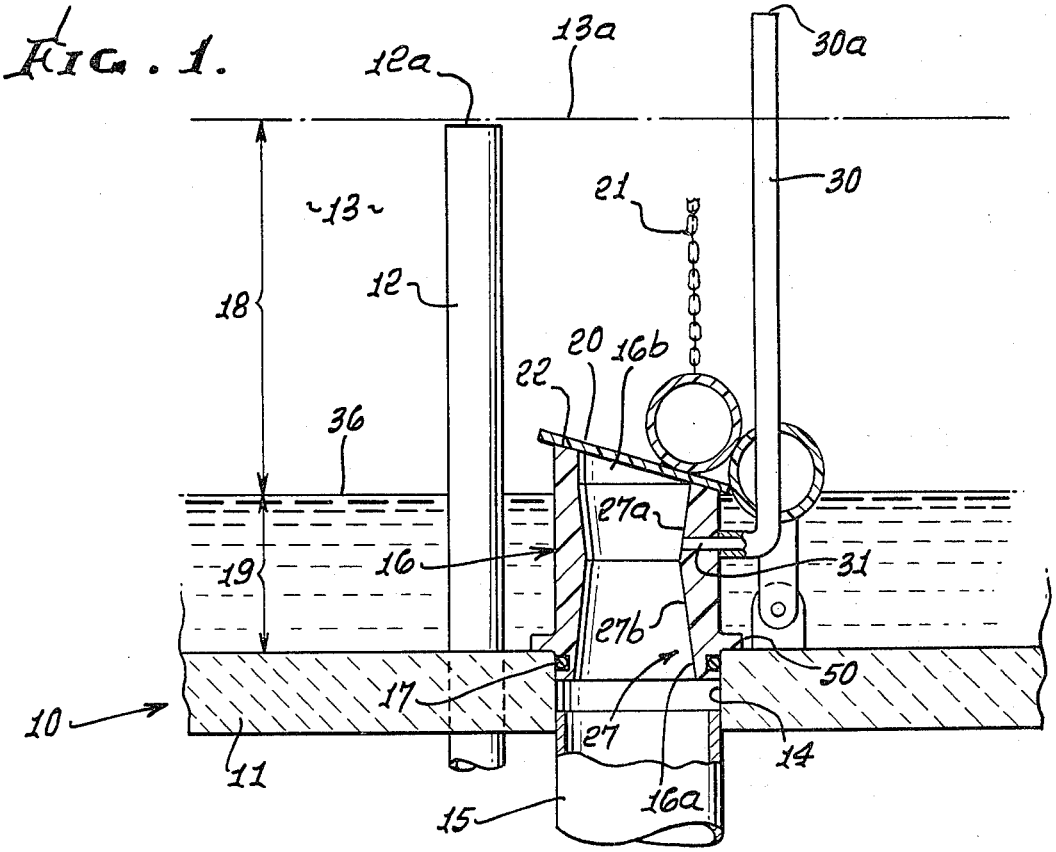
FIG. 1 is an elevation, partly in section, showing details of apparatus incorporating the invention.
Figure 3:
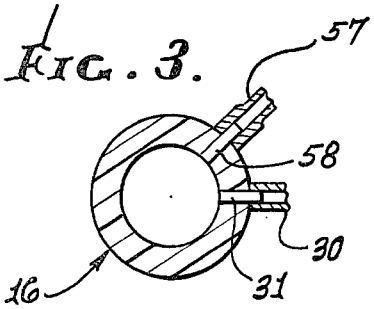
FIG. 3 is an enlarged section on lines 3—3 of FIG. 2.

In the drawings, a toilet flush water holding tank is shown at 10, the tank having a bottom wall 11. A conventional stand pipe 12 extends vertically to receive over-flow water from within the tank, the top opening of the stand pipe being from within the tank, the top opening of the stand pipe being indicated at 12*a* at the upper level 13*a* of the water 13 in the tank. The bottom wall 11 contains an outlet opening 14 for passing water to the toilet bowl during the flush cycle, and via pipe 15.

In accordance with the invention, a tubular body, as at 16, is located in drain communication with the opening 14. For example, a lower portion 16*a* of the body may be downwardly inserted to closely fit the opening 14, at selected level, and a suitable annular seal 17 may be provided, if desired, to seal off between the body and the opening. A flange 50 on body 16 seats downwardly on wall 11, and may be bonded in place. The tubular body has an inlet 16*b* spaced above the level of the opening 14 so that only the tank water above the level of inlet 16*b* will flow out through the body during the flush cycle. Such water depth is indicated at 18, and water that does not flow out, i.e. that is retained or saved, is indicated at 19. A flapper valve 20 extends over opening 16*b*, at an angle as shown, to be pulled upward as by a chain 21 so as to open the drain. The flapper valve normally seats at 22 on the body.

The body 16 contains a venturi 27 acting to accelerate the downward flow through the body when the flapper valve is lifted. That venturi may be integral with the body and include oppositely tapered sections 27*a* and 27*b* which together extend throughout the major length of the body. Such acceleration is of advantage in that it compensates for the loss of tank water head or pressure due to the elevation of inlet 16*b* above outlet 14; accordingly, the elapsed time for flush water drainage from level 13*a* to level 36 (at the level of inlet 16*b*) is kept close to the normal elapsed time for drainage from level 13*a* to the bottom of the tank, as when tube 16 is not used.

In addition, the loss of total water volume delivered to the toilet bowl is compensated for by passing air to mix with the water draining through the tube. This function is performed by ducting including an air duct communicating with the venturi via the side of tube 16. For example, an air pipe 30 may be extended upward in the tank to provide an air inlet 30*a* above water level 13*a;* the pipe communicates at its lower end with a duct 31 through the side wall of the tube and opening to or near the throat of the venturi. Accordingly, air is drawn downwardly via the tube 30 and duct 31 to mix with water rushing through the venturi.

Also provided is means connected with the body to conduct chemical fluid to the venturi, via the side of tube 16. Such means includes a container 51 supported by the tank 10. For example, second attachment means may be provided to removably attach the container 51 to the tank, at the inner side thereof. Such second attachment means is shown to include a clip or bracket 52 having a hook-shaped upper portion 52*a* hung over the upper rim 53 of wall 10', and so that the vitreous cover 54 of the tank may easily be placed over same. The clip has a lower support portion 52*b* forming a pocket into which the container lower portion fits with slight interference, to hold the container in position despite filling of flush water into the tank.

Figure 4:
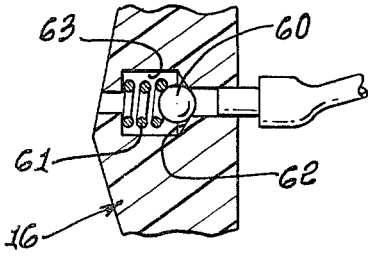
FIG. 4 is an enlarged section showing a modification of chemical liquid delivery to the venturi.
Figure 2:
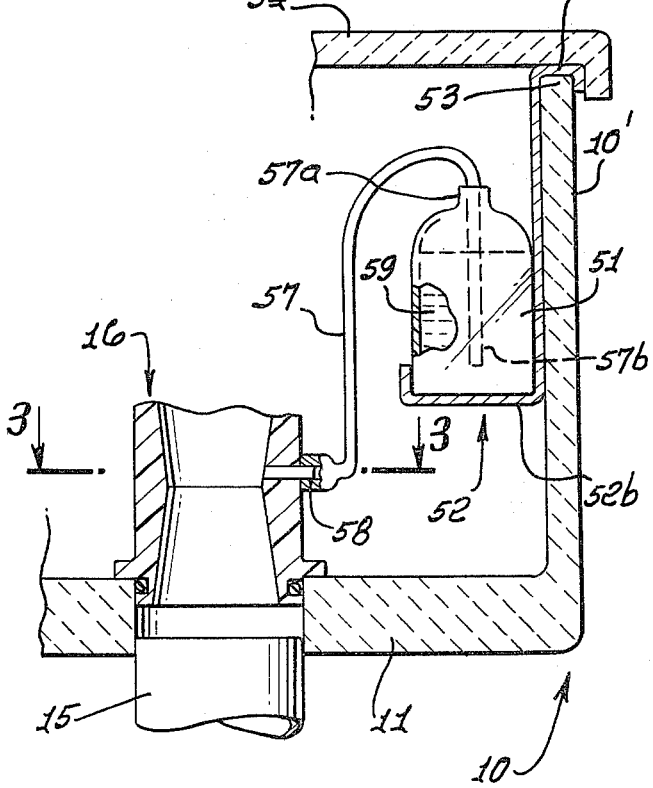
FIG. 2 is an elevation similar to FIG. 1, showing another vertical section through the venturi tube.

The means to conduct chemical fluid in container 51 to the venturi includes a flexible tube 57 connected to a second duct 58 extending through the side wall of tubular body 16 and opening to or near the throat of the venturi. The opposite end 57*b* of tube 57 is inserted through the top or open neck 51*a* of the container, and into the chemical liquid therein. The latter typically consists of an aqueous disinfectant 59 (chlorinated for example), an example being LYSOL. Accordingly, the liquid disinfectant is drawn from the container 51 into the flush water flowing downwardly through the venturi 27, and at the same time, that flush water is aerated as described, the turbulant flow mixed with disinfectant achieving maximum disinfecting action in the toilet bowl. In this regard, the tube 58 is preferably separate from tube 30, so that the suction transmitted to liquid in container 51 is optimized for drawing liquid to the venturi. Siphoning may be prevented for example by use of a light ball check valve, including a ball 60 lightly spring urged at 61, to seat at 62 in a bore 63 in body 16. See FIG 4 in this regard.

As a result, the apparatus saves appreciable water during each flush cycle; compensates for the reduced pressure and volume of the flow in such manner as to produce a near normal flush fluid volume and flow rate, but using substantially less water, and provides for disinfectant flow to the flush water during flushing only.

I claim:

1. In combination with a toilet flush tank having a bottom wall drain opening, the improvement comprising:

(a) a tubular body adjustably located in drain communication with said opening and having an inlet spaced above the level of said opening so that only tank water above the level of said inlet will flow downward through said body during the toilet flush cycle, (b) the body containing a venturi to accelerate said flow, (c) means connected with said body to conduct chemical fluid to said venturi, said means including a container supported by the tank, and (d) said means to conduct chemical fluid to the venturi includes a tube connected with said ducting and inserted into said container to draw fluid from the container in response to flush water flow downwardly through the venturi.

2. The combination of claim 1 wherein a lower portion of said body is received in said drain opening.

3. The combination of claim 1 including attachment means removably attaching said container to said tank.

4. The combination of claim 3 wherein said body consists of molded plastic material, and contains ducting opening to said venturi for passing fluid thereto.

5. The combination of claim 3 wherein said attachment means includes a clip attached to a rim portion of the tank, the container suspended by the clip, in the tank.

6. The combination of claim 5 wherein said chemical fluid consists of aqueous disinfectant in the container.

7. The combination of claim 1 including an air pipe extending upwardly in the tank and having an air inlet, the lower end of the pipe connected with said venturi via ducting in the body, the pipe adapted to pass air to flush water flow through the venturi to aerate the flow.

8. The combination of claim 1 including anti-siphon means associated with said means to conduct chemical fluid to the venturi.

9. The combination of claim 7 wherein said ducting connected with said chemical fluid flow tube and said ducting connected with said air pipe are spaced apart in said body.

* * * * *